United States Patent [19]

Flugger

[11] Patent Number: 4,809,812

[45] Date of Patent: Mar. 7, 1989

[54] CONVERGING, CORRIDOR-BASED, SOUND-ATTENUATING MUFFLER AND METHOD

[75] Inventor: Ray T. Flugger, Santa Rosa, Calif.

[73] Assignee: Flowmaster, Inc., Santa Rosa, Calif.

[21] Appl. No.: 837,607

[22] Filed: Mar. 7, 1986

Related U.S. Application Data

[63] Continuation-in-part of Ser. No. 548,304, Nov. 3, 1983, Pat. No. 4,574,914.

[51] Int. Cl.[4] ..... F01N 1/08

[52] U.S. Cl. ..... 181/268; 181/265; 181/272; 181/275; 181/281; 181/282; 181/296

[58] Field of Search ..... 181/232, 268, 272, 275, 181/281, 296, 265, 282

[56] References Cited

U.S. PATENT DOCUMENTS

| | | | |
|---|---|---|---|
| 624,062 | 5/1899 | Mattews et al. | 181/264 |
| 1,081,348 | 12/1913 | Unke et al. | 181/264 |
| 1,184,431 | 5/1916 | Dodge | 181/264 |
| 1,677,570 | 7/1928 | Stade . | |
| 1,756,916 | 4/1930 | Stranahan . | |
| 1,772,589 | 8/1930 | Beaner | 181/265 |
| 1,866,004 | 7/1932 | Beaner | 181/265 |
| 1,946,908 | 2/1934 | Hanson | 181/265 |
| 1,984,707 | 12/1934 | Sommer | 181/275 |
| 2,071,351 | 2/1937 | McNamara . | |
| 2,239,549 | 4/1941 | Chipley . | |
| 2,325,905 | 8/1943 | Caulfield | 181/268 |
| 2,485,555 | 10/1949 | Bester . | |
| 2,667,940 | 2/1954 | Gallihugh | 181/265 |
| 2,806,548 | 9/1957 | Carroll | 181/268 X |
| 2,934,889 | 5/1960 | Poulos . | |
| 2,971,599 | 2/1961 | Tobias . | |
| 3,029,895 | 4/1962 | Lyon | 181/264 |
| 3,029,896 | 4/1962 | Lyon . | |
| 3,219,141 | 11/1965 | Williamitis . | |
| 3,704,763 | 12/1972 | Becker et al. | 181/268 |
| 3,786,896 | 1/1974 | Foster et al. | 181/265 |
| 4,143,739 | 3/1979 | Nordlie | 181/265 |
| 4,165,798 | 8/1979 | Martinez | 181/268 |
| 4,220,219 | 9/1980 | Flugger | 181/268 X |
| 4,315,559 | 2/1982 | Casey | 181/268 X |
| 4,346,783 | 8/1982 | Scarton et al. | 181/265 X |
| 4,359,134 | 11/1982 | Jackson | 181/268 X |

FOREIGN PATENT DOCUMENTS

| | | |
|---|---|---|
| 316875 | 12/1919 | Fed. Rep. of Germany . |
| 285604 | 2/1928 | United Kingdom . |

*Primary Examiner*—Benjamin R. Fuller

*Attorney, Agent, or Firm*—Flehr, Hohbach, Test, Albritton & Herbert

[57] ABSTRACT

A compact, sound-attenuating muffler for an internal combustion engine is disclosed in which the muffler includes a stream dividing partition positioned proximate the inlet of the muffler to divide the incoming exhaust gases into two streams of substantially equal volume. The stream dividing partition directs the streams laterally of the inlet in directions diverging from each other, and the muffler sound-attenuating assembly further includes corridor defining partitions receiving the streams from the stream dividing partition and maintaining the streams in corridors as coherent substantially eddy-free streams. The corridor defining partitions further direct the streams laterally to converge towards each other for discharge of the coherent streams against each other from opposed directions in a common volume inside the muffler casing. Further sound attenuation is accomplished by a common channel receiving the streams after they are intersected or discharged against each other. A method of attenuating the sound entrained in the exhaust gases of an internal combustion engine is also disclosed. The method includes dividing the gases into two streams, diverging the gases, converging the gases while maintaining them in substantially eddy-free coherent streams, and discharging the gases against each other to produce like-frequency sound attenuation without substantial back pressure increase.

6 Claims, 3 Drawing Sheets

CONVERGING, CORRIDOR-BASED, SOUND-ATTENUATING MUFFLER AND METHOD

RELATED APPLICATION

This application is a continuation-in-part application based upon copending application Ser. No. 548,304, filed Nov. 3, 1983 and entitled COMPACT, SOUND-ATTENUATION MUFFLER FOR HIGH-PERFORMANCE, INTERNAL COMBUSTION ENGINE, now U.S. Pat. No. 4,574,914, issued Mar. 11, 1986.

BACKGROUND OF THE INVENTION

Numerous muffler constructions have been proposed for the attenuation of the sound component of an exhaust gas stream from an internal combustion engine. Invariably, these structures have purported to effect sound attenuation without substantially or intolerably increasing the back pressure on the engine. As is well known, muffler induced back pressure will substantially reduce engine performance.

The problem of reduced performance is most extreme in high-performance racing engines. The "solution" to the problem which is actually used in the racing industry usually is to employ a straight pipe from the engine and tolerate the noise. With urban expansion, however, even race tracks are under pressure to reduce the noise level during racing. Moreover, at least some high performance cars also are driven, at least occasionally, on the city streets. In order to be "street-legal" such high performance engines must be coupled to a muffler, and the only mufflers which are currently commercially available that are used on such high-performance engines cause a significant drop in engine power as a direct result of the back pressure induced in the muffler.

Typically, a 575 horsepower engine will produce a noise level of about 130 decibels (db) at hard acceleration with no muffler, and on the same engine when a commercially available high-performance muffler is used, the noise level will be reduced to about 95 db (A scale) at hard acceleration, but there also will be an 18% to 20% power loss. Even larger engines, for example 700 to 800 horsepower, have more cam overlap and cannot tolerate sound attenuation to 95 db since it would produce a 30% to 40% power loss.

Another problem that complicates any attempt to attenuate sound in high-performance internal combustion engines is the necessity to minimize bulk and weight. The exhaust pipe on a high horsepower engine typically will be about 4 inches in diameter so as to accommodate the very substantial volumetric flow. Mufflers which depend upon excessive length or diameter to achieve sound attenuation will be unsuitable for use on race cars, either because of their bulk or weight, or both.

The patent art contains various muffler constructions which purport to solve the problem of sound attenuation without undesirable back pressure, but in fact these various structures have substantial performance deficiencies. It is well known to provide a divergently tapered centrally located conical partition for flow of gases around the partition to effect an expansion of the gases. Typical of such structures are the devices shown in U.S. Pat. Nos. 2,071,351; 2,239,549; and 2,971,599. Some of these patented mufflers follow such an expansion partition or cone with a contraction or concentrating partition or baffle. Typical of such devices are the mufflers shown in U.S. Pat. Nos. 1,081,348; 2,667,940; 3,029,895; and 3,29,896. These mufflers, however, do significantly increase back pressure by causing the exhaust gases to reverse the direction of their flow axially a they attempt to pass beyond the concentrating or converging baffle. This flow reversal may be effective in sound attenuation, but it has been found to increase back pressure undesirably.

Even mufflers which employ alternating divergent and then convergent partitions have suffered from undesirable bulk and/or weight, inordinate complexity, or auxiliary flow channels or openings in the partitions which defeat sound attenuation. Typical of such mufflers are the mufflers set forth in U.S. Pat. Nos. 624,062; 1,184,431; 2,325,905; and 2,485,555.

Additional patent art known to applicant but believed to be peripheral in relevance to the present invention are the following U.S. Pat. Nos. 1,677,570; 1,756,916; 1,946,908; 2,934,889; 3,219,141; 3,786,896; 4,143,739; and 4,346,783.

The reality of the industry is that high-performance racing cars are either using no muffler or mufflers which barely achieve the desired sound attenuation, and achieve it at a significant power loss and with an undesirable increase in bulk and weight.

An additional complication results when a high-performance or conventional internal combustion engine is turbocharged. The exhaust gases from such turbocharged engines exit the engine in a rather turbulent stream, instead of coherent pulses typical of engines which are not turbocharged. Thus, the effect of turbo charging on the exhaust gases from an internal combustion engine is to substantially increase the turbulence of the gases as they enter the muffler.

In a turbocharged engine the turbulence also tends to entrain the sound in a more uniform manner throughout the volume of the exhaust gases as compared to an unturbocharged engine in which the sound can be preferentially distributed in the pulses. In the unturbocharged engine, therefore, a back pressure increase can enhance the uniformity of sound attenuation by the muffler partition system, but for turbocharged exhausts any back pressure increase in the muffler is simply undesirable because the sound component is already thoroughly mixed with the volume of the exhaust gases.

OBJECTS AND SUMMARY OF INVENTION

A. Objects of Invention.

Accordingly, it is an object of the present invention to provide a compact, lightweight, sound-attenuating muffler for a high-performance internal combustion engine or the like which achieves sound attenuation without significant decrease in engine performance.

It is another object of the present invention to provide a highly effective sound-attenuating muffler for high-performance, internal combustion engine which is simple to construct, is compact, can be used on race cars or the like, is durable and is lightweight.

A further object of the present invention is to provide a sound-attenuating muffler which is well suited for use with turbocharged internal combustion engines.

Still another object of the present invention is t provide a method of attenuating the sound component of the exhaust gases from internal combustion engines, and particularly turbocharged engines, which effects sound attenuation with minimum degradation of engine performance.

The compact, sound-attenuating muffler of the present invention has other objects and features of advantage which will become apparent from and are set forth in more detail in the following description of the preferred embodiment and the accompanying drawing.

B. Summary of the Invention.

The compact, sound-attenuating muffler of the present invention includes a casing having an inlet opening, an outlet opening, and sound-attenuating means intermediate the openings. The improvement in the muffler comprises, briefly, the sound-attenuating means including stream dividing means positioned proximate the inlet opening to divide the incoming exhaust gases into two streams of substantially equal volume with the stream dividing means directing the two streams laterally of the inlet opening in directions diverging from each other; and corridor defining means receiving the streams from the stream dividing means and maintaining the streams in corridors as coherent, substantially eddy-free streams with the corridor defining means further directing the streams laterally to converge towards each other for discharge of the coherent streams against each other from opposed directions in a common volume inside the muffler casing in advance of the outlet opening. The sound-attenuating means further preferably includes a common channel defining portion receiving the exhaust gases from the common volume at which the streams are intersected with the common channel defining portion directing the exhaust gases from the common volume in a single stream toward the outlet opening.

In the preferred form the mufflers constructed with a diamond-shaped partition which divides the incoming gases into two streams and a cooperating converging partition in spaced relation to the backside of the diamond-shaped partition to provide the corridor for convergence of the two streams toward a common intersection volume without allowing the streams to become excessively turbulent.

The method of attenuating sound of the present invention is comprised, briefly, of the steps of dividing the exhaust gases into two streams of substantially equal volume, directing the two streams to diverge away from each other, converging the streams together for intersection in a common volume, and during the converging step maintaining the streams as substantially eddy-free coherent streams.

DESCRIPTION OF THE PREFERRED EMBODIMENT

Figure 1:
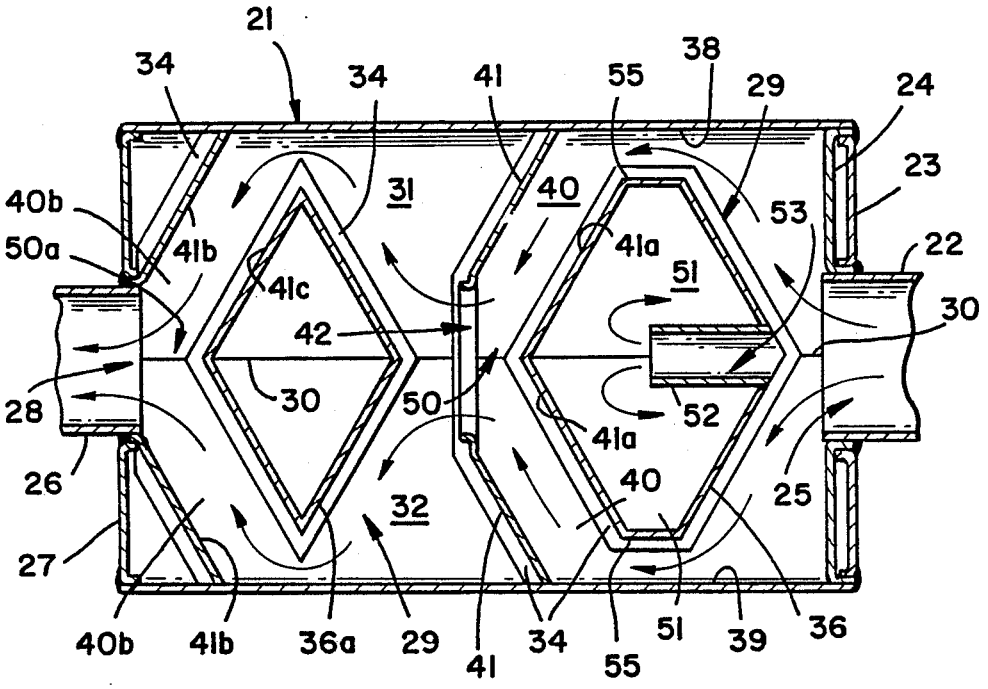
FIG. 1 is a top plan view in cross-section taken substantially along the plane of line 1—1 in FIG. 2 and showing a muffler constructed in accordance with the present invention.
Figure 2:
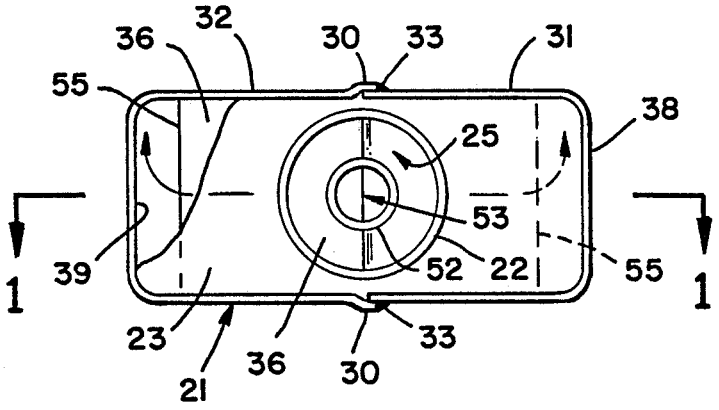
FIG. 2 is a front elevation view, partially broken away, of the muffler of FIG. 1.

The muffler of the present invention can be seen in FIGS. 1 and 2 to include a casing, generally designated 21, an inlet pipe 22 extending through casing end wall members 23 and 24 for the flow of exhaust gases through inlet opening 25 into casing 21. The muffler further includes an outlet pipe 26 mounted to extend through casing end wall 27 and provide an outlet opening 28 for the discharge of gases from the casing. Mounted in casing 21 is sound-attenuating means, generally designated 29, which is formed for the attenuation of the sound component in the exhaust gases as the gases pass through the muffler, as will be described hereinafter in more detail.

In order to facilitate fabrication of a high-strength, durable muffler, casing 21 may be formed from longitudinally extending casing halves 31 and 32 which are joined together along longitudinally extending upper and lower seams 30, for example, by welding at 33. Casing end wall members 23, 24 and 27 are similarly welded to the ends of casing halves 31 and 32, and the inlet and outlet exhaust pipes 22 and 26 are in turn welded to the respective end walls of the casing. During the assembly process, sound-attenuating partition means 29, each of which includes flanges 34, can be inserted into assembled casing halves and welded in place.

The construction of muffler casing 21 as above described affords a structure which is very rigid and durable and accordingly capable of withstanding the substantial stresses inherent in high-performance muffler operation.

As best may be seen in FIG. 1, sound-attenuating means 29 includes a first partition or stream dividing means 36 which is divergently tapered from the longitudinal center line of the casing, which coincides with seam 30 between casing halves 31 and 32. First partition 36 deflects gases passing through inlet opening 25 from inlet exhaust pipe 22 into two streams of substantially equal volume. The stream divider also directs the two stream laterally of inlet 25 toward the side walls 38 and 39 of casing 21. Mounted downstream of stream dividing means 36 is a corridor defining means comprised of a second partition 41 and a pair of spaced-apart substantially parallel walls **41*a* on a back or downstream side of stream divider 36. Partition 41 is formed to be convergently tapered with respect to the central longitudinal axis of the muffler, and walls 41*a* define a corridor 40 therebetween. Partition 41 is formed with central opening means 42 so that gases converging from walls 38 and 39 pass through central opening 42, at which point they are discharged from the casing or, as shown in the drawing, impact another stream dividing means 36*a***.

In the muffler shown in the drawing, the divergence and convergence of the exhaust stream is repeated. Thus, the exhaust gases are successively deflected by another converging corridor defining partition **41*b*, which cooperates with walls 41*c* to maintain the gases in a defined corridor 40*b* for discharge out of the muffler through outlet opening 28 in outlet exhaust pipe 26**.

It has been found that in internal combustion engines which are not turbocharged dividing the exhaust gases into two diverging streams and thereafter converging the streams for intersection at a common volume within the muffler, such as volumes 50 and **50*a*, will be highly effective in attenuating sound without an undesirable increase in the muffler back pressure. In fact, back pressure measurements have indicated that the muffler of the present invention produces a back pressure comparable to or lower than a straight pipe. It is believed that the convergence of two streams for intersection or discharge against each other in a common volume of the muffler housing results in cancellation of sound because of the convergence and intersection of sound components in the two streams of the same frequency. Moreover, that this intersection on the backside of stream dividing means 36** appears to result in a lowering of the back pressure as a result of the sound cancellation.

When the internal combustion engine is not turbocharged, corridor defining walls 41*a* and 41*c* have not been found to be necessary. As the pulses of exhaust gas are converged on the backside of the stream dividing means, there is turbulence in volume 50. Such turbulence will increase the back pressure in the muffler, but there is sufficient back pressure reduction from sound cancellation, that the net back pressure increase almost is negligible.

Figure 3:
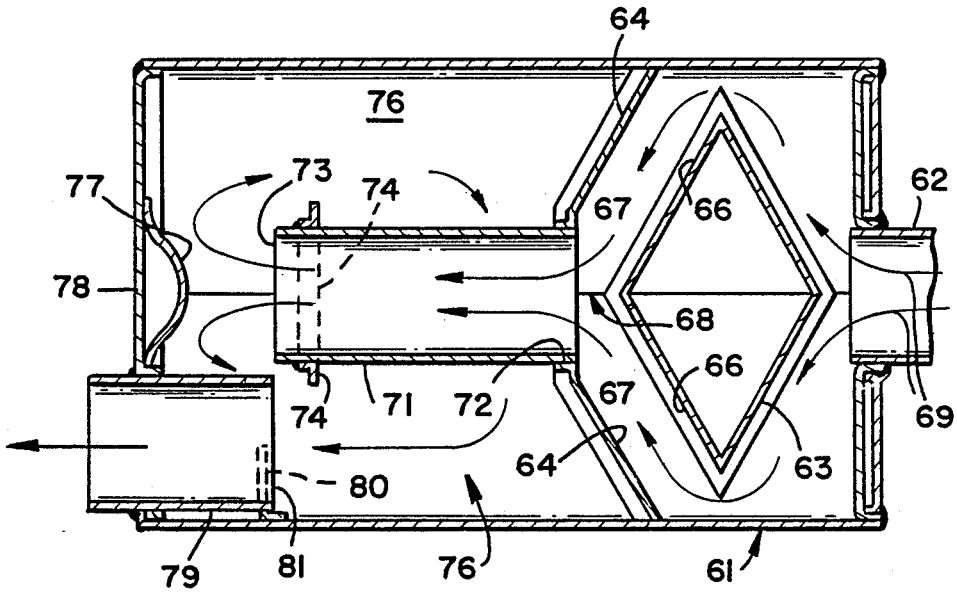
FIG. 3 is a top plan view in cross-section corresponding to FIG. 1 of an alternative embodiment of the muffler of the present invention.

When a muffler such as is shown in FIGS. 1 through 3 of my U.S. application Ser. No. 548,304 is mounted to a turbocharged engine, there is a significant increase in the muffler back pressure. This increase is believed to be due to the inherent turbulence in exhaust gases from turbocharged engines, which is then exacerbated on the backside of the stream dividing means employed in the muffler of my U.S. application Ser. No. 548,304. This stream divider inherently tends to generate eddy currents and swirling flow, which adds to the turbulence already present in turbocharged exhausts.

In the muffler of the present application walls 41*a* and 41*c* have been provided on the backside of the stream divider generally parallel to partition walls 41 and 41*b*, respectively. These back walls on the downstream side of the stream divider form corridors that maintain the two streams produced by the stream dividing partition as coherent, substantially eddy-free streams. These coherent streams then may be discharged or intersected against each other in common volumes 50 and 50*a*.

The result is that the muffler shown in FIGS. 1 and 2 of the present application is highly effective in attenuating sound in exhaust gases from turbocharged internal combustion engines. The convergence of these two coherent streams together again results in like-frequency sound cancellation with an attendant drop in back pressure that tends to reduce the back pressure of the already turbulent turbocharged exhaust gases.

In order to enhance the sound attenuation of the muffler of the present invention, it is further preferable to provide a Helmholtz chamber 51 inside the stream divider 36. Helmholtz chamber 51 is accessed by a tube 52 having an opening 53 generally coaxially aligned with inlet pipe 22. Helmholtz chamber 51 provides low frequency sound attenuation, which is well known in the muffler art, but incorporation of the Helmholtz chamber into the stream divider having a pair of back walls 41*a* affords effective sound attenuation without an increase in muffler size.

In FIG. 3, an alternative embodiment of the muffler of the present invention is shown in which muffler casing 61 has an inlet pipe 62 which discharges exhaust gases against diverging stream dividing means 63. The muffler includes corridor defining means provided by converging partition member 64 and parallel back walls 66 which define corridors 67 for the convergence of exhaust gas streams toward a common volume 68 on the backside of the stream divider.

Thus, a central partition of substantially diamond shaped top plan cross section is positioned in the muffler downstream of inlet pipe 62 with the upstream sides of the diamond diverting the exhaust outwardly, as indicated by arrows 69 and the downstream sides 66 providing a portion of corridor 67 with converging partition 64. The muffler of FIG. 3 does not include a Helmholtz chamber.

It has been found that substantial sound attenuation downstream of common volume 68 can be achieved if the muffler is further constructed with common channel defining means 71. As shown in FIG. 3, channel defining 71 is a tube mounted in opening 72 in the converging partition 64. The distal end 73 of tube 71 can be secured to the top and bottom walls of casing 61 by a mounting bracket 74.

Most preferably, common channel defining partition 71 has a length dimension greater than its diameter. In most vehicles this length dimension is on the order of about two times the diameter of pipe 71, if pipe 71 is used as a tailpipe. If pipe 71 is inside the muffler, as shown in FIG. 3, it may be shorter and seldom would exceed 4 inches. It is believed that the coupling of a common channel defining portion 71 for immediate receipt of converging and intersecting streams from common volume 68 has the effect of increasing the sound component intersection and cancellation. The common channel defining portion 71 attenuates sound to a degree which is almost as effective as providing a second stream divider and corridor defining structure, such as partition 36*a* in FIG. 2.

It is preferable, however, to include a chamber 76 downstream of common channel defining tube 71. Gases from tube 71, therefore, are discharged against a protruding diverter plate 77 mounted to end wall 78 of the muffler housing. This plate helps reinforce the muffler against the heat of the gases as they are discharged against the end wall. As will be seen by the arrows in chamber 76, plate 77 also assists in reversing flow of the gases which swirl in the chamber and are discharged out of outlet pipe 79 positioned in non-aligned relation to pipe 71. Most preferably, pipe 79 is axially positioned so that the upstream end 81, secured by bracket 80, is at about the same axial position a distal end 73 of pipe 71.

Gases are discharged into chamber 76 which has a volume substantially greater than the pipe 7 to permit expansion and swirling of the gases prior to exit from the muffler. This swirling action does increase turbulence and back pressure to some degree but the substantial increase in volume of chamber 76 tends to maintain the increase at acceptable levels.

It should also be noted that the provision of a stream divider having back walls, such as walls 66 in FIG. 3 and walls 41*a* and 41*c* in FIG. 1, has an additional substantial advantage in connection with high-performance racing cars. Any muffler which permits a buildup of fuel, and particularly alcohol, in the muffler can cause dangerous backfiring. Thus, the provision of defined corridors not only reduces turbulence in the muffler, but also insures that fuel does not build up on the backside of the stream divider. Obviously, the muffler of FIG. 3 would not be well suited for use on a racing automobile because of the chamber 76.

Figure 4:
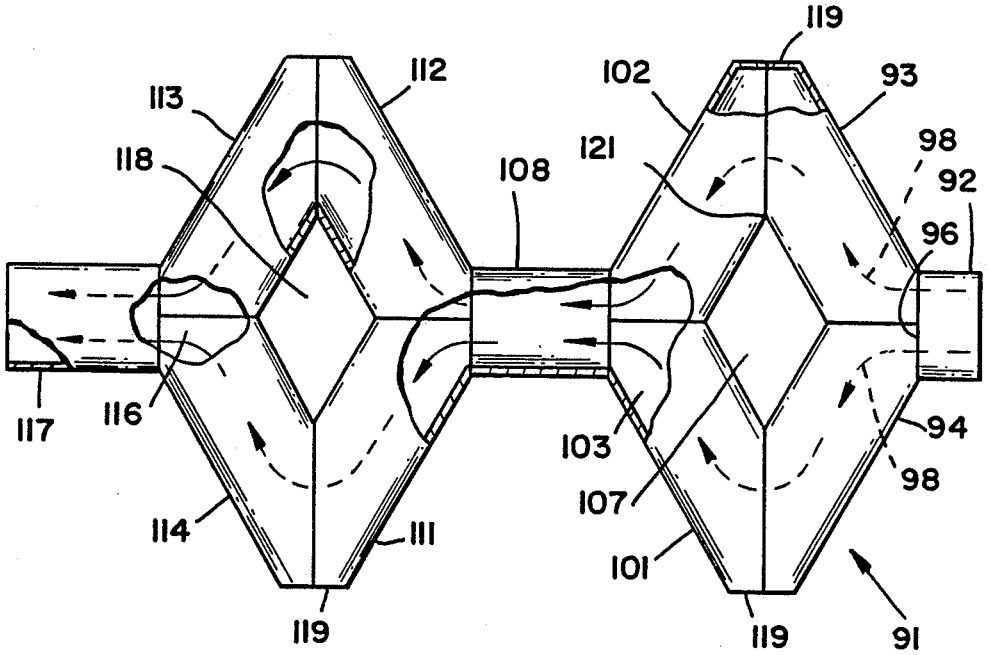
FIG. 4 is a top plan view, partially broken away, of a further alternative embodiment of the muffler of the present invention.

A form of the muffler of the present invention which is particularly easy to construct is shown in FIG. 4. Thus, muffler 91 is formed from a series of pipes which are joined, for example, by welding, to produce the diverging and converging structure which results in a high degree of sound attenuation without back pressure increase. An inlet conduit or pipe 92 is secured to a first pair of diverging conduit means or pipes 93 and 94 at seam 96. The pipes 93 and 94 are joined at seam 97 along a common plane positioned downstream of the inlet and proximate the central axis of inlet pipe 92 to provide a stream dividing means. Incoming gases diverge laterally as shown by arrows 98 and travel along the first pair of pipes 93 and 94 in opposite diverging directions.

In order to produce convergence of the gases, a second pair of pipes 101 and 102 define a first pair of converging conduit means downstream of the diverging conduit means. Pipes 101 and 102 provide corridors 103 for the flow of gases in coherent streams toward a common volume 104 proximate the ends 106 of pipes 101 and 102. (The diamond shaped area 107 is outside the muffler casing.)

Gases are discharged against each other in common volume 104 and then proceed through common conduit 108, which enhances sound attenuation, to an additional diverging-converging pipe assembly.

The additional pipe assembly includes a third pair of tubes 111 and 112, which cause the gases to diverge and a fourth pair of tubes 113 and 114, which converge and provide corridors to a common volume 116 immediately in advance of outlet pipe 117. (Again, the area 118 inside the second assembly of tubes is actually outside of the muffler.)

It should be noted that this structure can also be easily cast to provide the necessary conduit means, rather than formed by an assembly of pipes. As shown in FIG. 4, the outside edges of the pipes are truncated at 119, and if the assembly is cast, it would be preferable to further truncate the inner edges 121 to reflect the truncation 119. In a similar fashion, the diamond-shaped structure in the mufflers previously described can also have truncated edges, for example, as shown at 55 in FIG. 1.

Figure 5:
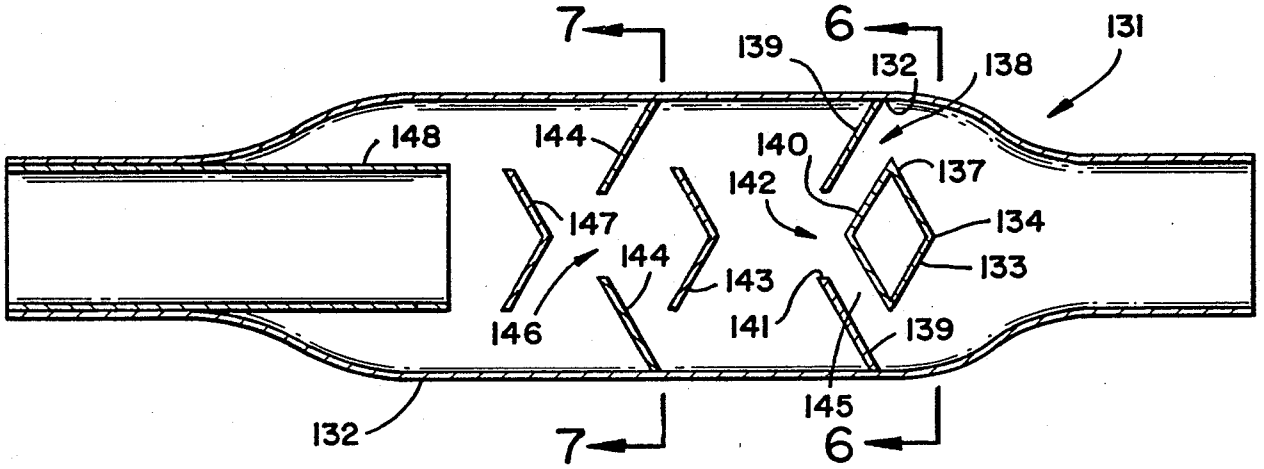
FIG. 5 is a top plan view in cross-section corresponding to FIG. 1 of a further alternative embodiment of the muffler of the present invention.
Figure 6:
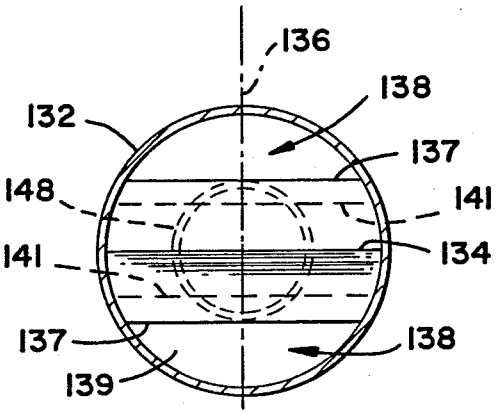
FIG. 6 is a cross-sectional view taken substantially along the plane of line 6—6 in FIG. 5.
Figure 7:
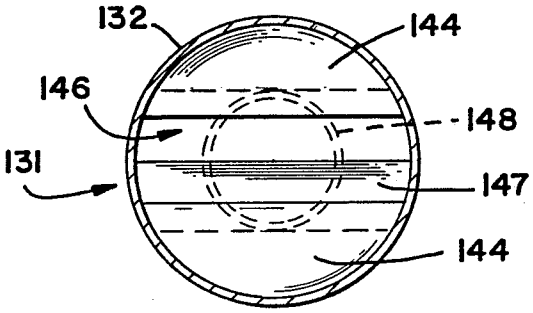
FIG. 7 is a cross-sectional view taken substantially along the plane of line 7—7 in FIG. 5.

Referring now to FIGS. 5, 6 and 7, a muffler, generally designated 131, which is particularly well suited for use with an engine which is not turbocharged, such as a motorcycle engine, is shown. Muffler 131 includes a generally cylindrical casing 132 in which a stream dividing means or first partition 133 is mounted to the casing to extend over the full diameter of the casing along a first axis 134. First partition 133 terminates short of the full diameter of casing 132 along a second axis 136 perpendicular to first axis 134. Thus, the edges 137 of diamond-shaped first partition 133 and sidewall 132 define a pair of D-shaped openings 13 (FIG. 6) proximate opposite sidewall portions of the casing.

In order to cause convergence of the divided exhaust streams, the muffler further includes second partition means provided as a pair of D-shaped partitions 139 positioned downstream of and in aligned relation to D-shaped openings 138. Partitions 139 extend inwardly from sidewall 132 a distance greater than openings 138 so that the inner edges 141 terminate in spaced relation to each other inwardly of edges 137 to define an opening or elongated slot 142 through which the exhaust gases must converge and pass. In the muffler of FIGS. 5–7, a second stream dividing partition 143 and second converging set of partitions 144 defining an elongated slot-like opening 146 also is provided. Mounted downstream from the second set of diverging and converging partitions is a third diverging or stream splitting partition 147 which is mounted in spaced relation to outlet pipe 148.

In the muffler of FIGS. 5–7, the first stream divider 133 is provided with back or downstream walls 140 which cooperate with partitions 139 to define a corridor 145 therebetween. This construction reduces turbulence sufficiently such that subsequent downstream dividers need not have a diamond-shaped cross section.

The method of attenuating sound untrained in the exhaust gases of an internal combustion engine of the present invention includes the steps of dividing exhaust gases into two streams of substantially equal volume. Such division can be accomplished by stream dividing means such as hereinabove described. After the dividing step, the two streams are directed to diverge away from each other so as to permit subsequent convergence and intersection of the stream together from opposite directions to produce common frequency sound cancellation and attenuation. The method, therefore, further includes the step of converging the diverging streams together toward each other for intersection in a common volume for like-frequency sound attenuation. Moreover, the method of the present invention includes the step of maintaining the streams as substantially eddy-free coherent streams during the converging step, for example, by providing corridor defining partitions, so that stream turbulence is not increased during convergence.

Additionally, the method of the present invention includes effecting further sound attenuation by the step of directing the intersected streams together as a single combined stream for a distance greater than the diameter of the combined stream after the streams have been converged and intersected.

EXAMPLES

Using a muffler constructed substantially as shown in FIGS. 1 and 2, but without the Helmholtz chamber, tests were conducted on a turbocharged Chrysler 2.2 liter 146 horsepower of engine. The back pressure was measured with a straight tailpipe having a length of about 24 inches and found to be 0.75 pounds per square inch. The muffler of the present invention was then placed on the engine in place of the straight tailpipe and the back pressure was found to be essentially zero.

The muffler of the present invention was then compared against a standard Chrysler muffler for the same turbocharged engine. The exhaust system included a catalytic converter and a complete exhaust system assembly. The back pressure of the assembly was measured at the engine in front of the catalytic converter. The back pressure for the complete system including the standard muffler was 3.5 pounds per square inch, and the back pressure for the system with the muffler of the present invention was 2.7 pounds per square inch. Back pressure was measured at 6000 rpm under full load. Sound attenuation at 3000 rpm was measured and found to be reduced by 5 dbA as compared to the standard muffler. Since 3000 rpm is about the normal operating speed of the engine, the reduction is regarded as highly significant. It should be noted that the muffler of the present invention also exhibited approximately 1 dbA decrease in sound increase during heavy acceleration, as compared to a standard Chrysler muffler. (Using SAE J 986 test procedures). In a high-performance race car, mufflers constructed as shown in FIGS. 1 and 2 were tested. The first muffler has only a single chamber, i.e., one stream divider 36 and corridor forming partition 41. The second muffler had two chambers, as shown in FIG. 1. The mufflers were compared to open headers on a 165 cubic inch Pontiac engine. The corrected brake horsepower (CBHP) and brake specific fuel consumption (BSFC) were measured on a dynometer for various rpm.

The results were as follows:

| | Maximum Horsepower | | |
|---|---|---|---|
| | rpm | CBHP | BSFC |
| Open headers | 7250 | 313.5 | 0.43 |
| One Chamber | 7250 | 322.1 | 0.42 |
| Two Chambers | 7250 | 320.8 | 0.43 |

As is apparent the two mufflers of the present invention resulted in significant increases in maximum horsepower and exhibited a slight reduction in fuel consumption. Sound attenuation was substantial as compared to open headers. Moreover, the power increase was comparable at all rpm ranges.

Tests were also conducted using a muffler having a sound attenuating common tube downstream of the corridor defining partitions, as shown in FIG. 3 by tube 71. It was found that approximately 1 decibel of sound attenuation can be achieved for each inch of length of tube 71 up to about 4 inches on a 2.5 inch diameter tube. As the length of tube 11 increased and sound attenuation became more effective, the back pressure also decreased.

What is claimed is:

1. A compact, sound-attenuating muffler for an internal combustion engine, said muffler including a casing having an inlet opening, an outlet opening, and sound-attenuating means intermediate the openings, wherein the improvement in said muffler comprises:

said sound attenuating means including:

(i) wedge-shaped stream dividing partition positioned proximate said inlet opening and diverging in opposite directions from an apex along a first axis toward opposite side walls of said casing, said stream dividing partition extending completely across said casing along a second axis perpendicular to said first axis and terminating short of said opposite side walls along said first axis to divide incoming exhaust gases into two discrete streams of substantially equal volume, said stream dividing partition directing said streams toward said opposite side walls and in directions each having a component toward said outlet opening; and (ii) corridor defining means including two pairs of partitions mounted in side-by-side substantially parallel relation inside said casing, and pairs of partitions defining with said casing two corridors, said pairs of partitions receiving said discrete streams from said stream dividing partition and maintaining said stream in said two corridors with each corridor having substantially a constant cross section area over the length of said two corridors for unrestricted constant-volume flow of said exhaust gases as coherent substantially eddy-free streams in said two corridors, said two pairs of partitions further directing said streams laterally away from said side walls to converge toward each other and producing intersecting of said coherent streams against each other from opposed directions in a substantially unobstructed common volume inside said casing in advance of said outlet opening, said two corridors maintaining the direction of flow of said exhaust gases in said casing always in a direction having a component progressing from said inlet opening toward said outlet opening to thereby minimize backpressure in said muffler and to minimize eddy currents in said streams as intersected against each other in said common volume.

2. The sound-attenuating muffler as defined in claim 1 wherein, said sound-attenuating means further includes a common channel defining portion receiving said exhaust gases from said common volume and combining said gases for flow in a single stream of predetermined cross section, said common channel defining portion being mounted to discharge said exhaust gases into a chamber in said casing proximate said outlet opening having a cross section greater than the cross section of said common channel defining portion.

3. A sound-attenuating muffler for an internal combustion engine, said muffler including a casing having an inlet conduit, an outlet conduit and means for attenuation intermediate said inlet conduit and said outlet conduit, wherein the improvement in said muffler comprises:

said casing and said sound attenuating means are provided by:

a first pair of diverging conduits joined together at a common plane, positioned downstream of said inlet conduit and positioned proximate a central axis of said inlet conduit, a first pair of converging conduits each having a substantially constant cross sectional area over a length thereof and each being in fluid communication with and downstream of said diverging conduits, said first converging conduits being joined at the ends thereof to provide a common volume, a second pair of diverging conduits joined together at a common plane positioned downstream of said first pair of converging conduit and positioned proximate a central axis of said common volume, a second pair of converging conduits each having a substantially constant cross sectional area over a length thereof and each being in fluid communication with and downstream of said second pair of diverging conduits, and said outlet conduit positioned and joined to said second pair of converging conduits to receive gases therefrom.

4. The sound-attenuating muffler as defined in claim 8 wherein, said first pair of diverging conduits are provided by a first pair of tubes of substantially constant diameter joined proximate a central axis of said muffler to each other and to said inlet conduit, said first pair of converging conduits are provided by a second pair of tubes of substantially constant diameter joined to said first pair of tubes at one end and joined together at an opposite end, said second pair of diverging conduits are provided by a third pair of tubes of substantially constant diameter joined to each other and joined to said second pair of tubes at said opposite end, and said second pair of converging conduits are is provided by a fourth pair of tubes of substantially constant diameter joined to said third pair of tubes at one end and joined together and to said outlet conduit an opposite end.

5. A compact, sound-attenuating muffler for an internal combustion engine including a casing having an inlet opening, an outlet opening, and means for sound attenuation intermediate the inlet and outlet openings, wherein the improvement in said muffler comprises:

said sound-attenuating means including:

(i) stream dividing means positioned proximate said inlet opening to divide incoming exhaust gases into two streams of substantially equal volume, said stream dividing means directing said streams laterally of said inlet opening in directions diverging from each other; and (ii) corridor defining means receiving said streams from said stream dividing means and maintaining said streams in corridors as coherent substantially eddy-free streams, said corridor defining means further directly said streams laterally to converge toward each other for discharge of said coherent streams against each other form opposed directions in a common volume inside said casing in advance of said outlet opening, and said stream dividing means and said corridor defining means are provided by:

a central partition means having a substantially diamond shaped top plan cross section with upstream sides providing said stream dividing means and downstream sides providing a portion of said corridor defining means, said central partition means being positioned centrally in said casing in front of said inlet opening with transverse ends of said central partition means terminating in spaced relation to said casing for the passage of said streams of exhaust gases therebetween, and a converging partition mounted in spaced and substantially parallel relation to said downstream sides of said central partition and extending inwardly from said casing to provide with said downstream sides a remaining portion of said corridor defining means, said converging partition means being formed with a central opening for the flow of exhaust gases therethrough after discharge of said streams against each other.

6. A method of attenuating the sound entrained in the exhaust gases of an internal combustion engine by muffler means having a casing with an inlet opening at one end and an outlet opening at an opposite end, comprising the steps of:

dividing said exhaust gases into two individually distinct streams of substantially equal volume inside said casing;

after said dividing step, directing the streams to diverge away form each other inside said casing;

after said directing step, converging said streams together inside said casing toward each other for intersection of said streams in a substantially unobstructed common volume;

during said converging step, maintaining aid streams as substantially eddy-free coherent streams of substantially constant cross section area; and during said dividing, directing and converging steps, maintaining the flow of said gases progressing in said casing always.

in a direction less than normal to an interior of the casing from said inlet opening toward said outlet opening.

* * * * *

UNITED STATES PATENT AND TRADEMARK OFFICE

CERTIFICATE OF CORRECTION

PATENT NO. : 4,809,812

DATED : March 7, 1989

INVENTOR(S) : Ray T. Flugger

It is certified that error appears in the above-identified patent and that said Letters Patent is hereby corrected as shown below:

Column 2, line 65, after "invention is" delete "t" and insert ---to---.

Column 4, line 44, delete "stream" and insert ---streams---.

Column 6, line 48, after "pipe" delete "7" and insert ---71---.

Column 7, line 52, after "openings" delete "13" and insert ---138---.

Column 8, line 9, delete "untrained" and insert ---entrained---.

Column 9, line 27, after "tube" delete "11" and insert ---71---.

IN THE CLAIMS:

Claim 6, Column 12, line 24, after "maintaining" delete "aid" and insert ---said---.

UNITED STATES PATENT AND TRADEMARK OFFICE

CERTIFICATE OF CORRECTION

PATENT NO. : 4,809,812

DATED : March 7, 1989

INVENTOR(S) : Ray T. Flugger

It is certified that error appears in the above-identified patent and that said Letters Patent is hereby corrected as shown below:

Claim 6, line 29, after "always" delete ".".

Signed and Sealed this

Twenty-second Day of August, 1989

*Attest:*

*Attesting Officer*

DONALD J. QUIGG

*Commissioner of Patents and Trademarks*